US006168492B1

(12) United States Patent
Glassberg

(10) Patent No.: US 6,168,492 B1
(45) **Date of Patent: *Jan. 2, 2001**

(54) BALANCING TOY WITH ADJUSTABLE WEIGHTS

(76) Inventor: Dennis Glassberg, 5 Winmere Pl., Dix Hills, NY (US) 11746

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/196,834

(22) Filed: Nov. 20, 1998

(51) Int. Cl.[7] ..... A63H 15/06
(52) U.S. Cl. ..... 446/396; 496/325; 496/326
(58) Field of Search ..... 446/69, 325, 326, 446/396, 487, 227; 273/156, 449, 450; 434/276, 300

(56) References Cited

U.S. PATENT DOCUMENTS 1,235,050 * 7/1917 Pajeau .
2,190,800 * 2/1940 Murphy .
3,092,384 * 6/1963 Herne .
3,614,106 * 10/1971 Morrison et al. .
5,516,314 * 5/1996 Anderson ..... 446/374
5,720,645 * 2/1998 Dugan ..... 446/396
5,762,531 * 6/1998 Witkin ..... 446/374

* cited by examiner

*Primary Examiner*—Sam Rimell
(74) *Attorney, Agent, or Firm*—Schweitzer Cornman Gross & Bondell LLP

(57) ABSTRACT

A balancing toy has a base with an upwardly-extending, elongated support member upon which an assembly of a body portion and a plurality of balancing members having weights attached thereto can be balanced. The weights can be removably attachable to outward ends of the balancing members, or can be permanently attached to, or integrally formed with the balancing members. The balancing members can be rigid and can be attached to the body portion in a plurality of locations to alter the center of gravity of the assembly of the body portion and the balancing members. Alternatively, the balancing members can include deformable support arms to alter the positions of the weights relative to the body portion.

12 Claims, 10 Drawing Sheets

BALANCING TOY WITH ADJUSTABLE WEIGHTS

FIELD OF THE INVENTION

The invention pertains to the field of balancing toys.

SUMMARY OF THE INVENTION

The invention comprises a balancing toy having one or more multi-piece or unitary bodies which can be balanced (or stacked) in various positions on a support member, such as a base having an upwardly-extending, elongated support element. The toy can also be balanced on any other suitable support. Attached to each body are preferably two balancing members having weights fixed adjacent outward ends of the balancing members. The locations of the balancing members and/or the position of each weight can be adjusted to vary the center of gravity of the assembly of the body and the balancing members such that the assembly can be balancing upon the base in various positions.

In one embodiment of the invention, the balancing members are integrally connected to the body, and, for example, can be in the form of deformable human- or other animal-like arms. Alternatively, the balancing members can be removably attached to the body in one of a plurality of pre-formed, snap-in recesses. Or, if the body member is comprised of deformable material, such as styrofoam, soft plastic, or the like, the balancing members can be removably inserted into the body.

The weights can be permanently attached to, or integrally formed with elongated support arms of the balancing members, or can be removably attachable such as with a snap-together assembly. If the weights are removable, weights of various mass can be provided. If the weights are integrally formed with the support arms of the balancing members, a plurality of balancing members can be provided with various lengths and/or weight masses. The balancing members can be substantially rigid or can be deformable to vary the center of gravity of the body/balancing member assembly.

In the embodiment comprising a multi-piece body, the body is preferably formed from left and right pieces each having an elongated longitudinal slot through which fastening means, such as a screw/nut assembly can be inserted. The elongated slots in the left and right pieces allow the relative positions and relative angle between the left and right pieces to be adjusted to vary the shape and center of gravity of the body.

The adjustability of the shape and center of gravity of the body, and the adjustability of the positions (and mass) of the weights attached to the body provides that the body/balancing member assembly can be balanced on the support member in various positions. In addition, multiple body/balancing member assemblies can be stacked, one upon the other in a variety of configurations, to form a unique and interesting displays.

BRIEF DESCRIPTION OF THE DRAWINGS

For a complete understanding of the above and other features of the invention, reference shall be made to the following detailed description of the preferred embodiments of the invention and to the accompanying drawings, wherein.

DETAILED DESCRIPTION OF THE INVENTION

Figure 1:
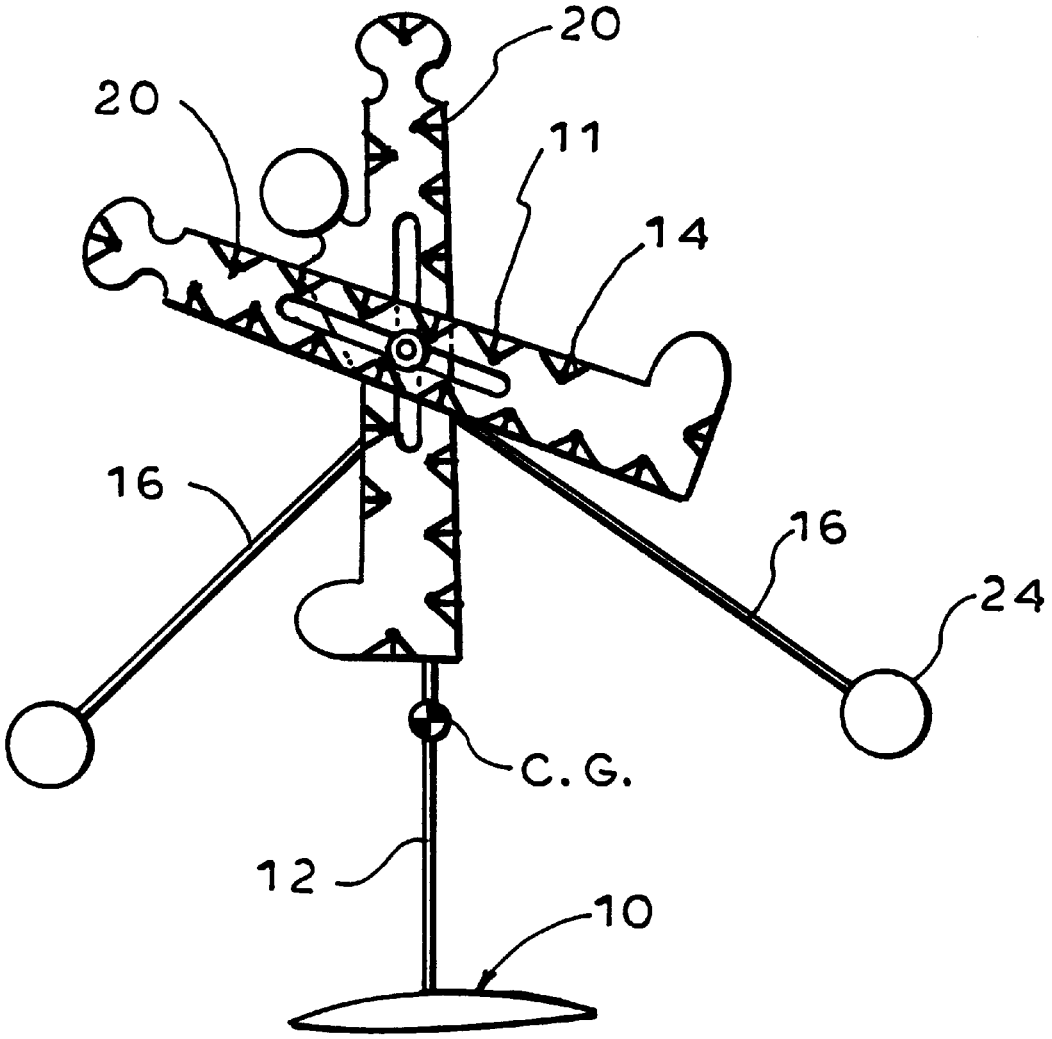
FIG. 1 is a front elevational view of a first embodiment of the invention.
Figure 11:
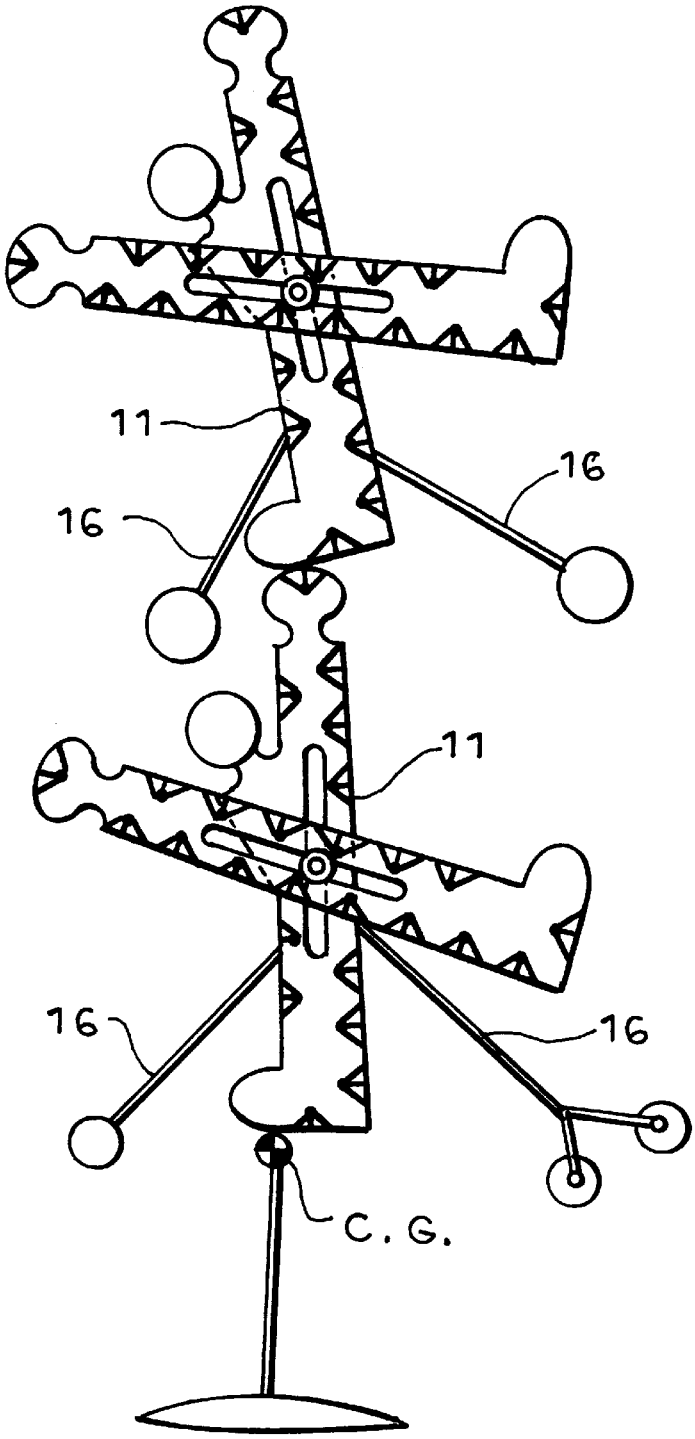
FIG. 11 is a side elevational view of a composite display of a plurality of balancing toys stacked on a single support.

Referring to FIG. 1, a first embodiment of the invention is shown mounted upon a support member 10 with an upwardly-extending, elongated support element 12 upon which an assembly 11 of a body portion 14 and balancing members 16 can be balanced. The assembly 11 can be balanced on the support element 12 when the center of gravity of the assembly 11 is directly below the upward end extremity 15 of the support element 12. Additional assemblies as shown in FIG. 11 can be balanced on the assembly 11 by adjusting the balancing members and position of the assemblies until substantial balance and equilibrium with respect to the support element is achieved.

The body portion 14 includes a plurality of multi-position, lateral attachment recesses 20 for preferably releasable attachment of the balancing members 16. Each balancing member 16 includes a weight 24 attached adjacent an end thereof, which, depending on the placement of the balancing member 16, affects the center of gravity of the assembly 11 of the body 14 and balancing members 16. The balancing members 16 can be attached to the body portion 14 in any one of a large number of configurations to provide a wide variety of positions in which the body 14 can be balanced upon the support element 12.

Referring to FIGS. 2A and 3A–3C, the balancing member 16 can comprise a first type of support arm 28, 28' which has an inward end portion 30 for engagement with the body portion 14, with a neck portion 31 and an enlarged end extremity 32, a substantially rigid, elongated shaft 34, and one or more outward end portions 36, each of which also preferably has a neck portion 37 and an enlarged end extremity 38. The first type of support arm 28, 28' is designed to support a first type of weight 40 by the outward end portion, which weight 40 has a lateral attachment recess 42 sized and shaped to releasably attach to the outward end portion 36 of the support arm 28.

The lateral attachment recess 42 preferably includes a channel portion 43 sized and shaped to partially encircle the neck portion 37 of the outer end portion 30 of the support arm 28. The channel portion 43 communicates with an enlarged recess 45 sized and shaped to accept the enlarged end extremity 38 of the support arm 28.

Figure 3A:
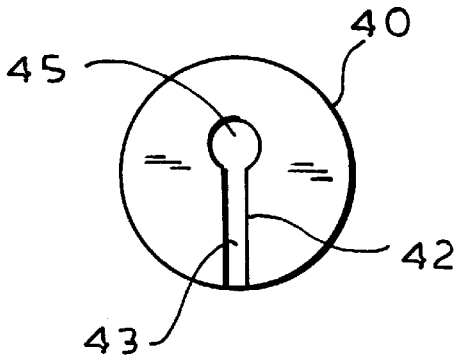
FIGS. 3A, 3B and 3C are top plan, and front and side sectional elevational views, respectively, of a first weight element of the invention.
Figure 3B:
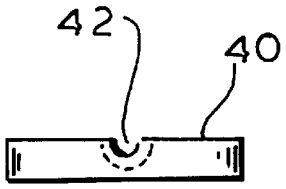
Figure 3C:
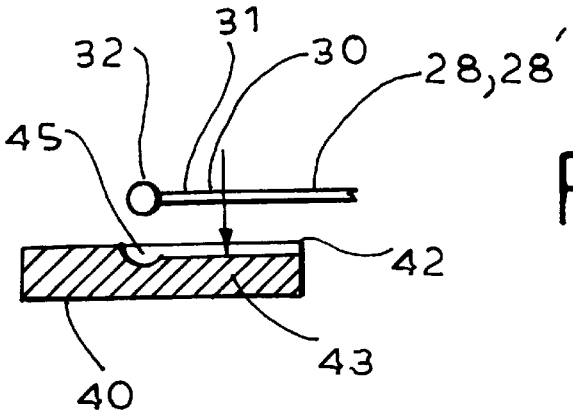

As best seen in FIG. 3C, the weight 40 is attached to the support arm 28 in a lateral motion in a direction perpendicular to the longitudinal axis of the channel portion 43 of the lateral attachment recess 42. The channel portion 43 can be sized to closely receive the neck portion 37 of the support arm 36 such that the support arm 38 is semi-permanently held therewithin with a friction or interference fit. Alternatively, the lateral attachment recess 42 can have a throat area (not shown) with an opening less than a diameter of the neck portion 37 of the support arm 28, which throat area is comprised of resiliently deformable material such that the support arm 28 can be semi-permanently snapped in place. Weights of various mass can be supplied.

Figure 2A:
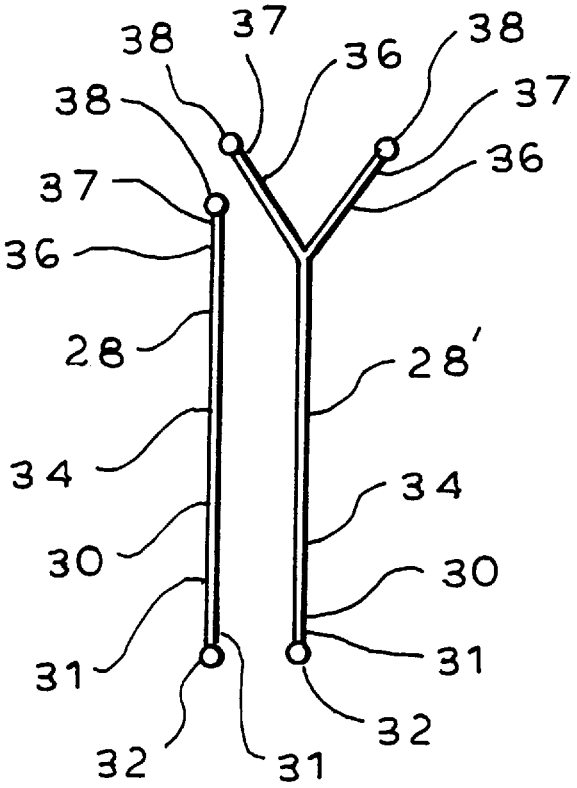
FIGS. 2A and 2B are side elevational views of first and second types of balancing member support arms of the invention.
Figure 2B:
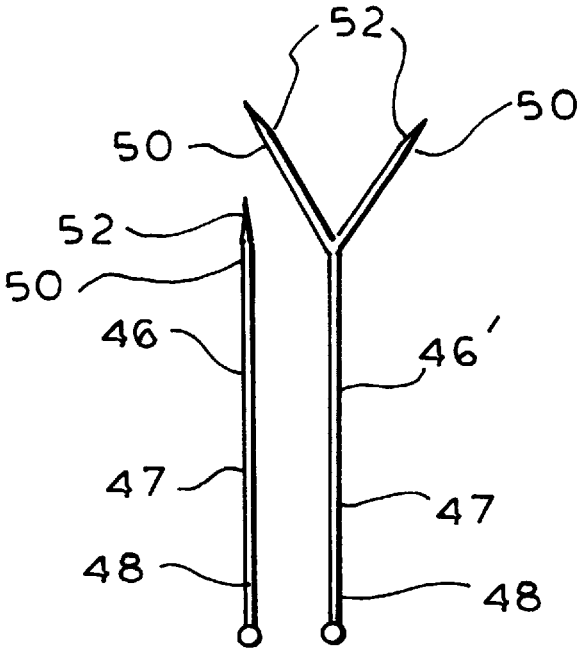
Figure 4A:
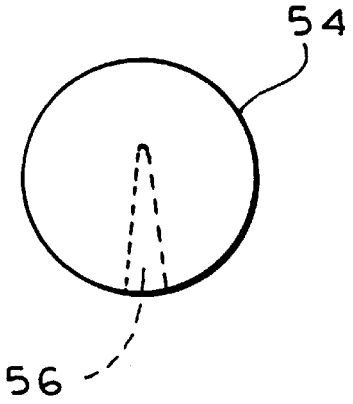
FIGS. 4A and 4B are top plan and side elevational views, respectively, of a second weight element of the invention.
Figure 4B:
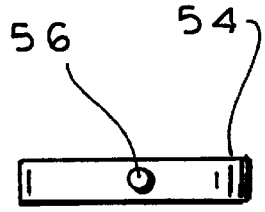

Referring to FIGS. 2B and 4A–4B, the balancing member 16 can include a second type of support arm 46, 46' which has an inward end portion 48 and substantially rigid, elongated shaft 47, both of which are preferably similar in shape and function to those portions of the first type of support arm 28. However, the second type of support arm 46 includes one or more outward end portions 50, each of which preferably has a tapered end extremity 52 for engagement with a weight. The second type of support arm 46 is designed to support a second type of weight 54, which weight 54 has an axial attachment recess 56 sized and shaped to releasably accommodate, in a friction or interference-fit, the outward end portion 50 and tapered end extremity 52 of the support arm 46. Thus, the second type of weight 54 may be attached to the second type of support arm 46 through an axial motion.

Figure 5:
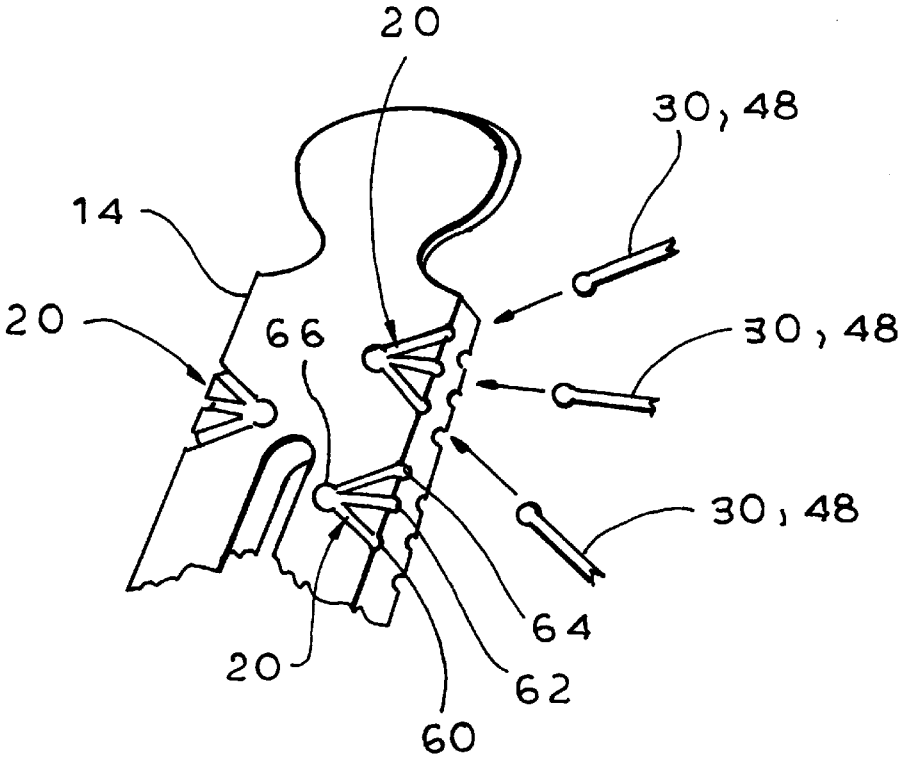
FIG. 5 is an enlarged perspective view of a portion of the body portion for FIG. 1, illustrating the connection of first and second types of balancing member support arms to the body portion.

Referring to FIG. 5, the multi-position lateral attachment recesses 20 of the body portion 14 are preferably disposed along substantially the entire periphery of the body portion 14, on both sides thereof, thereby providing a large number of attachment positions and angles in which the balancing members 16 can be connected to the body portion 14. Each recess 20 is sized and shaped to releasably accommodate an inward end portion 30, 48 of one of the types of support arms 28, 46. Preferably, each recess 20 includes three angularly-spaced channels 60, 62 and 64 each communicating with and extending radially outwardly to the edge of the body portion 14 from an enlarged center recess 66. The angularly-spaced channels 60, 62 and 64 and the enlarged center recess 66 can preferably have the configurations similar to the channel 43 and the enlarged center recess 45 in the first type of weight 40 described above with respect to FIG. 3C. However, it can be appreciated each multi-position lateral attachment recess 20 in the body portion 14 provides a number of angles at which the balancing member 16 can be attached with respect to the body portion 14.

Figure 6A:
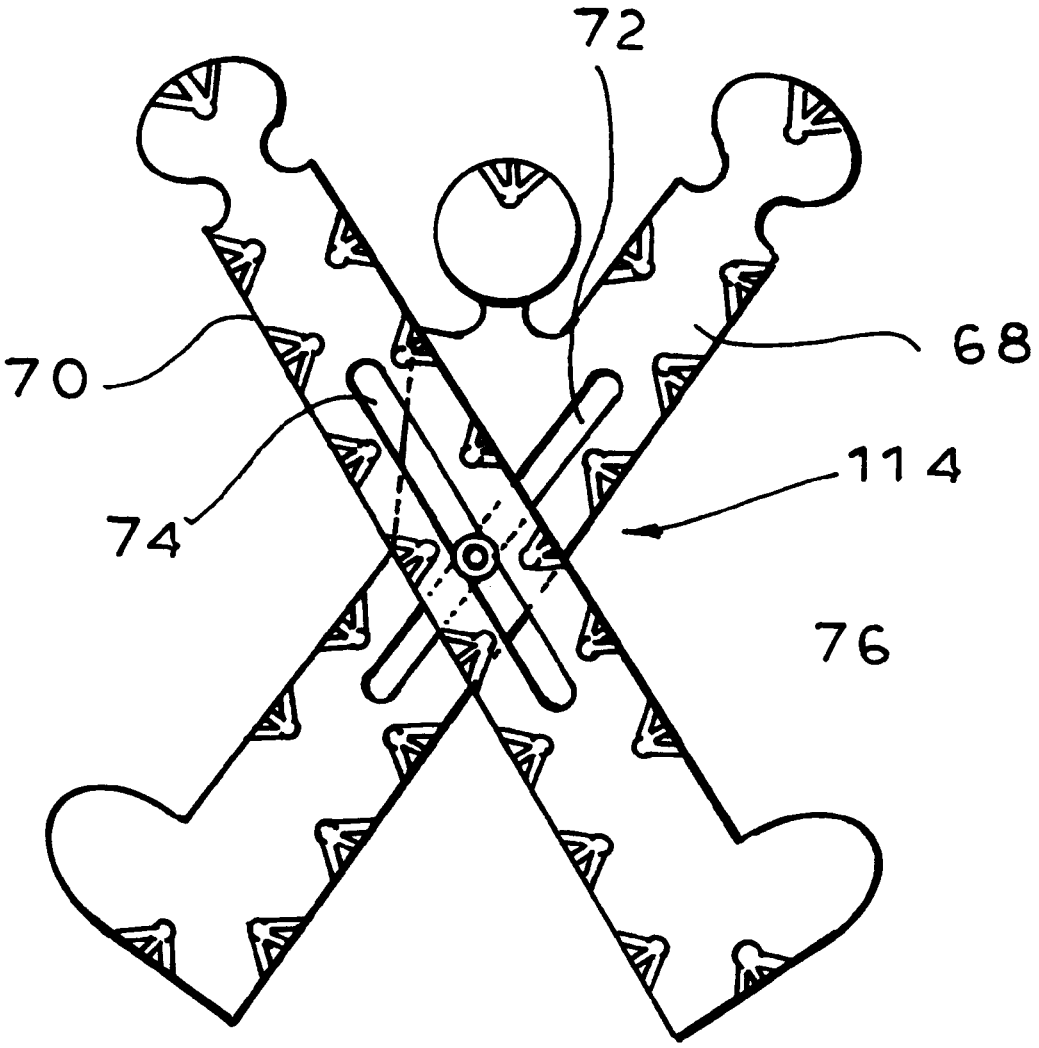
FIGS. 6A and 6B are front and side elevational views, respectively, of a second embodiment of the invention.
Figure 6B:
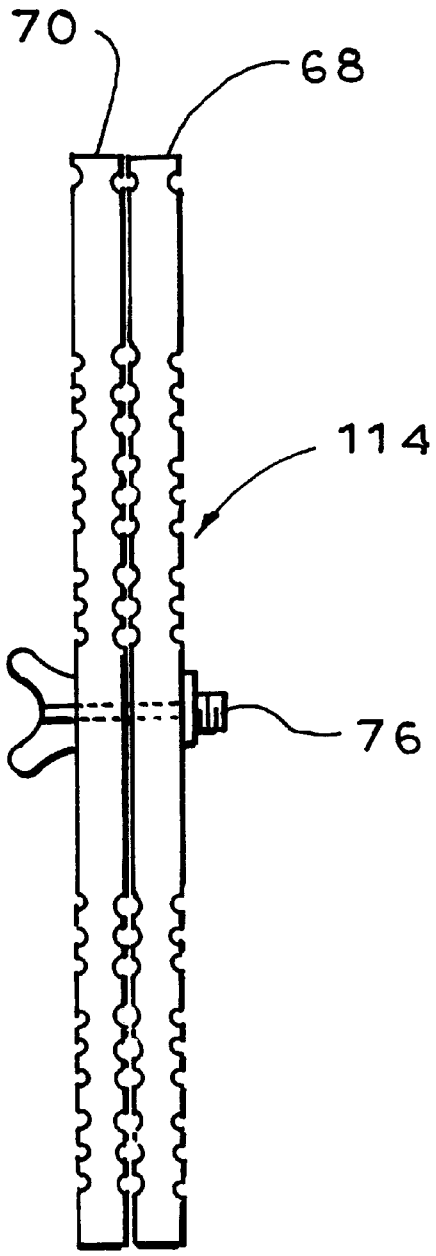

Referring to FIGS. 6A and 6B, a second embodiment of the body portion 114 includes two independent sides 68 and 70, each preferably having a longitudinal slot 72, 74 for assembly of the body portion 114. A fastening means, such as a screw/nut assembly 76, or any other suitable fastener, can be inserted through the longitudinal slots 72, 74 to secure the two sides 68, 70 together. It can be appreciated that the structure of the second embodiment provides that the two sides 68, 70 can be assembled in a plurality of configurations to vary the appearance and location of the center of gravity of the body portion 114.

Figure 8A:
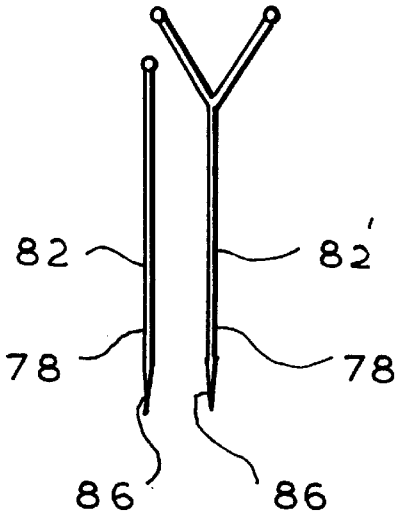
FIGS. 8A and 8B are side elevational views of the third and fourth types of balancing member support arms.
Figure 8B:
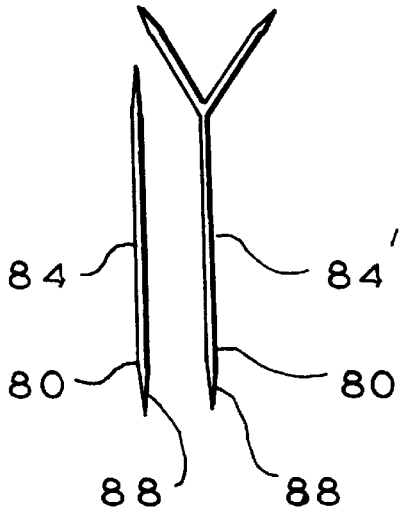
Figure 7:
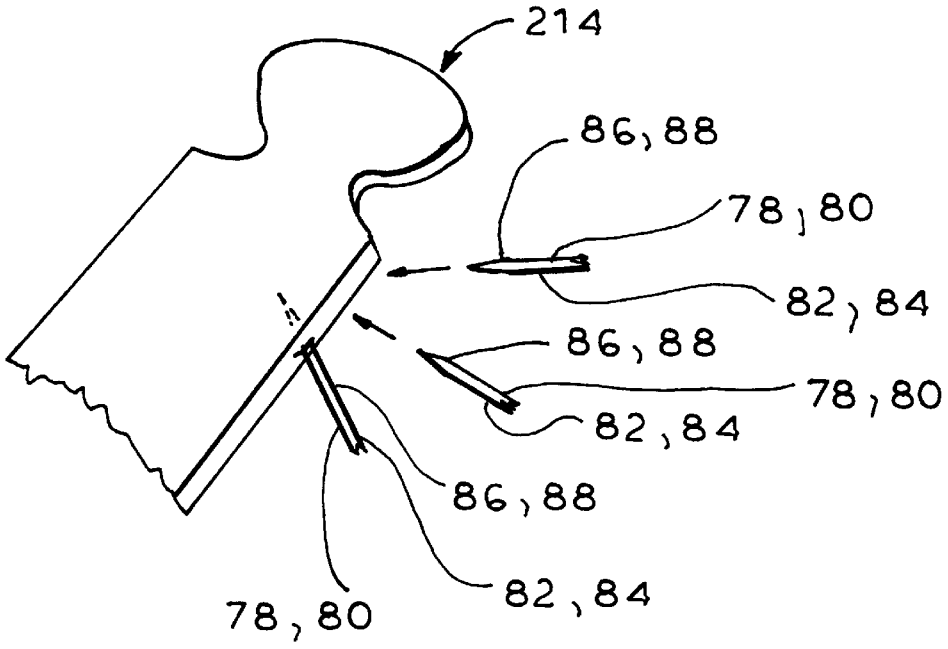
FIG. 7 is an enlarged perspective view of a portion of the body portion of a third embodiment of the invention, illustrating the connection of third and fourth types of balancing member support arms to the body portion.

Referring to FIGS. 7, 8A and 8B, a third embodiment of the body portion 214 is comprised of deformable material, such as the multicellular expanded synthetic resinous material sold under the trademark Styrofoam—, which trademark is owned by the Dow Chemical Company, soft plastic, or the like, into which the inward end portions 78, 80 of third and fourth types of support arms 82, 82', 84, 84' can be inserted. The inward end portions 78, 80 preferably include tapered end extremities 86, 88 which can puncture the material of the body portion 214. The outward end portions 90, 92 of the third and fourth types of support arms 82, 84 can be configured similarly to those of the first and second types of support arms 28, 46.

Figure 9:
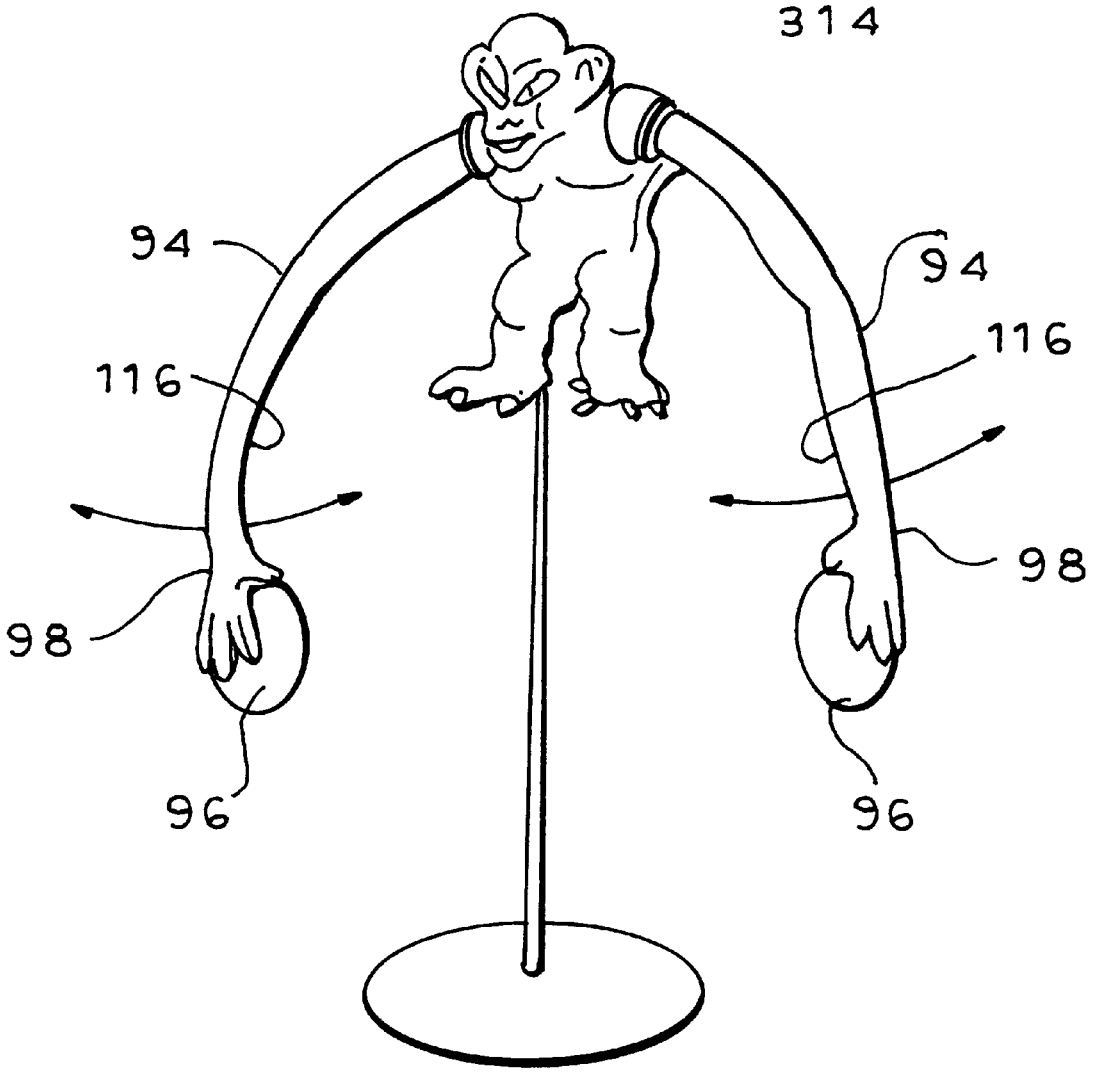
FIG. 9 is a front elevational view of a fourth embodiment of the invention.
Figure 10:
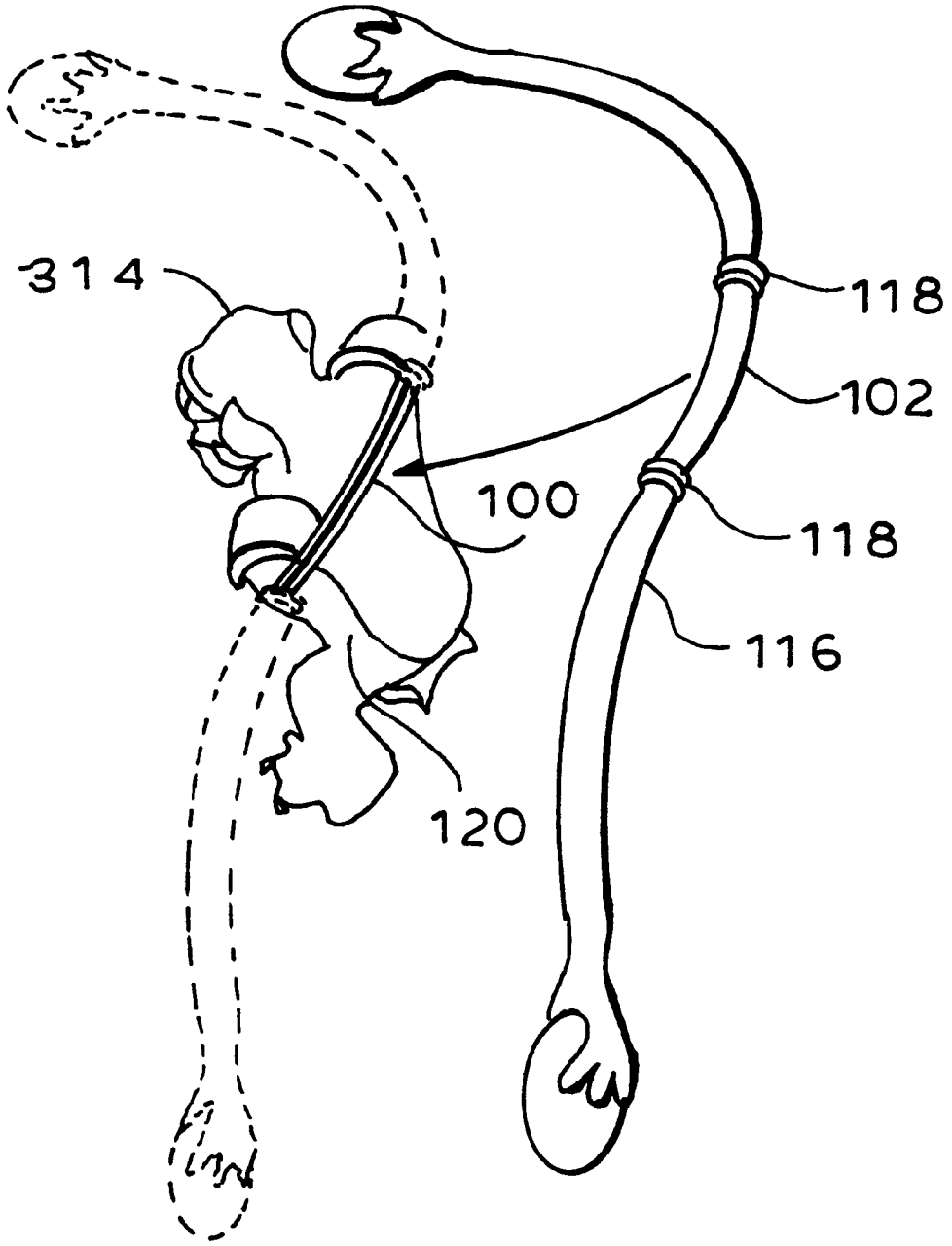
FIG. 10 is an enlarged, perspective view of a portion of the embodiment of FIG. 9, illustrating a method of attachment of the balancing members.

Referring to FIG. 9 and 10, in a fourth embodiment, the balancing members 116 include deformable arms 94 with weights 96 preferably permanently attached adjacent end portions 98 thereof. The deformable arms 94 can comprise malleable wire which can be easily formed into the desired shape. The balancing members 116 can be integrally formed with the body portion 314, for example in the appearance of animal arms, or can be releasably attachable to the body portion 314. To this end, the body portion 314 can include a slot 100 to receive a center portion 102 connecting the balancing members 116. The center portion 102 can include enlarged locating rings 118 which abut side walls 120 of the body portion 314 to insure proper positioning of the balancing members 116.

The slot can be sized and shaped to closely receive the center portion 102 in a friction or interference fit such that, when inserted therein, the center portion 102 is fixed relative to the body portion 314. In this manner the position of the weights 96 can be semi-permanently adjusted relative to the body portion 314 by deforming the arms 94, to affect the center of gravity of the assembly 311 of the body portion 314/balancing member 116, thereby altering the orientation of the assembly 311 when mounted on the base 310.

Referring to FIG. 11, it is contemplated that the toy of this invention can be provided in a kit having multiple body portions 11 and an assortment of balancing members 16 and weights as described above. In this manner, composite displays can be constructed by stacking multiple body/balancing member assemblies, all upon the other to form a challenging, visible and interesting display.

It should be understood, of course, that the specific forms of the invention herein illustrated and described is intended to be representative only, as certain changes may be made therein without departing from the clear teachings of the disclosure. Accordingly, reference should be made to the following appended claims in determining the full scope of the invention.

I claim:

1. A balancing toy for balancing on a support, the balancing toy comprising:

a body portion;

first and second balancing members extending outwardly from said body portion, each balancing member including a weight;

a position of each weight being adjustable relative to said body portion;

each balancing member being releasably attachable to said body portion in a plurality of locations;

said body portion including a plurality of pre-formed lateral attachment recesses;

each balancing member including an inward end portion sized and shaped for removable attachment to said body portion in one of said pre-formed lateral attachment recesses;

said inward end portion of each balancing member includes a neck portion and an enlarged end extremity;

each pre-formed lateral attachment recess including an enlarged recess sized and shaped to closely receive said enlarged end extremity of said inward end portion of said balancing member, and including a channel portion in communication with said enlarged recess and in communication with an edge of said body portion;

each pre-formed lateral attachment recess is sized and shaped to closely receive and removably retain said neck portion of said inward end portion of said balancing member; and said inward end portion of said balancing member being removably attachable to said body portion in a lateral direction perpendicular to a longitudinal axis of said channel portion of said attachment recess.

2. A balancing toy as in claim 1, wherein each pre-formed lateral attachment recess includes a plurality of angularly-spaced channel portions in communication with and extending radially outwardly from said enlarged recess, and in communication with said edge of said body portion to provide a plurality of angles at which a balancing member can be attached to said body portion.

3. A balancing toy as in claim 2 wherein:

said neck portion is substantially cylindrical; and said channel portion of said pre-formed lateral attachment recess includes a narrow throat portion formed of resiliently deformable material, which throat portion has a width less than a diameter of said neck portion.

4. A balancing toy as in claim 1, wherein each weight is removably attachable to one of said balancing members.

5. A balancing toy as in claim 4, wherein:

each balancing member includes an outward end portion with a tapered end extremity;

each weight includes an pre-formed axial attachment recess in communication with an edge of said weight; and said pre-formed axial attachment recess is sized and shaped to closely receive and removably retain said outward end portion of said balancing member.

6. A balancing toy as in claim 1, wherein:

said body portion is formed from two independent side portions, each having a longitudinal attachment slot;

said body portion includes fastening means directed through said longitudinal slots in said side portions; and said side portions being joinable to each other in a plurality of configurations to alter the appearance and center of gravity of said body portion.

7. A kit for a balancing toy of the type described in claim 1, wherein said kit comprises a plurality of body portions and a plurality of balancing members.

8. A kit as in claim 7, comprising an assortment of a variety of balancing members and weight masses.

9. A balancing toy as in claim 1, wherein:

said body portion is formed of a multicellular expanded synthetic resinous material;

each balancing member includes an inward end portion with a tapered end extremity; and said inward end portion being forcibly, removably insertable into said body portion in a plurality of locations and at a plurality of angles with respect to said body portion.

10. A balancing toy for balancing on a support, the balancing toy comprising:

a body portion;

an elongated support having an end extremity;

first and second balancing members extending outwardly from said body portion, each balancing member including a weight and being comprised of malleable metal wire such that the arms are easily deformable;

said balancing members being readily deformable such that a position of each weight is adjustable relative to said body portion by deforming a shape of said balancing members; and an assembly of said body portion and said balancing members being supportable on said end extremity of said support in a plurality of orientations, with a center of gravity of said assembly being directly below said end extremity of said support, in balanced equilibrium.

11. A balancing toy as in claim 10, wherein said balancing members are permanently attached to said body portion.

12. A balancing toy as in claim 10, wherein said balancing members are integrally connected by a center portion;

said body portion includes a balancing member attachment slot sized and shaped to closely receive said center portion; and said attachment slot is sized and shaped to frictionally retain said center portion and to substantially prevent rotation of said center portion with respect to said body portion;

whereby said support arms can be formed into desired shapes to position said weights with respect to said body portion, and whereby said relative positions of said weights will be retained when said body portion is mounted on said base.

* * * * *